US011285059B1

(12) United States Patent
Alexander

(10) Patent No.: US 11,285,059 B1
(45) Date of Patent: Mar. 29, 2022

(54) WHEELCHAIR CONVERTIBLE TO A WALKER

(71) Applicant: ALEXANDER IDEAS INC., Chicago, IL (US)

(72) Inventor: Scott Alexander, Chicago, IL (US)

(73) Assignee: ALEXANDER IDEAS INC., Chicago, IL (US)

( * ) Notice: Subject to any disclaimer, the term of this patent is extended or adjusted under 35 U.S.C. 154(b) by 0 days.

(21) Appl. No.: 17/115,892

(22) Filed: Dec. 9, 2020

(51) Int. Cl.

| | |
|---|---|
| ***A61H 3/04*** | (2006.01) |
| ***A61G 5/10*** | (2006.01) |
| ***A61G 5/14*** | (2006.01) |
| *A61G 5/02* | (2006.01) |

(52) U.S. Cl.
CPC ..... *A61G 5/1056* (2013.01); *A61G 5/14* (2013.01); *A61H 3/04* (2013.01); *A61G 5/02* (2013.01); *A61G 2200/34* (2013.01); *A61G 2200/36* (2013.01)

(58) Field of Classification Search
CPC .... A61G 3/04; A61G 2201/0161; A61G 5/08; A61G 5/124; A61G 5/14
See application file for complete search history.

(56) References Cited

U.S. PATENT DOCUMENTS 5,060,967 A * 10/1991 Hulterstrum ..... A61G 5/08 280/650
5,451,193 A * 9/1995 Pickard ..... A61G 5/00 280/250.1
5,558,358 A * 9/1996 Johnson ..... A61G 5/00 280/250.1
6,338,493 B1 * 1/2002 Wohlgemuth ..... A61G 5/00 135/66
6,921,101 B1 * 7/2005 Lauren ..... A61G 5/00 135/67
8,678,425 B2 * 3/2014 Schaaper ..... A61H 3/04 280/648
9,486,372 B2 * 11/2016 Robins ..... A61G 5/021
9,649,236 B1 * 5/2017 Wike, Jr. ..... A61G 5/1005
9,655,806 B2 * 5/2017 Naucke ..... A61G 5/1008
9,854,203 B2 * 12/2017 Benetti ..... H04N 7/142
10,172,751 B1 * 1/2019 Balmer ..... A61G 5/0833
10,182,956 B2 * 1/2019 Stryker ..... A61N 1/36003
10,675,207 B2 * 6/2020 VanAusdall ..... B62B 5/0438
10,765,586 B2 * 9/2020 Liang ..... A61H 1/00
10,966,888 B2 * 4/2021 Robins ..... A61G 5/128
2003/0151232 A1 * 8/2003 Li ..... A61G 5/08 280/648

(Continued)

*Primary Examiner* — Emma K Frick
(74) *Attorney, Agent, or Firm* — ARC IP Law, PC; Joseph J. Mayo

(57) ABSTRACT

Personal transportation aid that can be converted easily between a wheelchair and a walker. The device has handles that can be pushed forward to switch from wheelchair mode to walker mode. Pushing the handles forward causes the seat bottom of the wheelchair to flip up, opening a space where the user can stand to use the walker; the front wheels of the wheelchair are also pushed forward. Pulling the handles backwards returns the device to its wheelchair configuration, with the seat bottom flipped down and the front wheels moved backwards. Simple mechanical linkages may be used to flip the seat bottom up and down, and to push the front wheels forward and backwards; therefore the device does not require a power source or actuators.

5 Claims, 7 Drawing Sheets

(56) References Cited

U.S. PATENT DOCUMENTS

| | | | | |
|---|---|---|---|---|
| 2007/0283990 | A1* | 12/2007 | Fernandez | A61G 5/128 135/67 |
| 2013/0168931 | A1* | 7/2013 | Baraitaru | A61H 3/04 280/30 |
| 2017/0326019 | A1* | 11/2017 | Bramsiepe | B62B 7/04 |
| 2020/0008990 | A1* | 1/2020 | Harrison | B62K 13/06 |
| 2020/0352815 | A1* | 11/2020 | Raja | B60B 19/12 |
| 2021/0290475 | A1* | 9/2021 | Liang | A61H 3/04 |
| 2021/0361517 | A1* | 11/2021 | Reuveni | A61G 5/0891 |

* cited by examiner

WHEELCHAIR CONVERTIBLE TO A WALKER

BACKGROUND OF THE INVENTION

Field of the Invention

One or more embodiments of the invention are related to the fields of human transportation devices and walking aids. More particularly, but not by way of limitation, one or more embodiments of the invention enable a wheelchair that is convertible to a walker.

Description of the Related Art

Personal transportation aids known in the art include wheelchairs, for persons who cannot walk or prefer to not walk, and walkers, which provide support for persons who may have difficulties walking or need assistance with balance. Some users may be able to use either a wheelchair or a walker; for example, a person may be undergoing rehabilitation and may need to limit the amount of time walking. Although such users may be equipped with both a wheelchair and a walker, it may inconvenient or expensive for these users to have both devices. For example, a user who uses a wheelchair may not be able to spontaneously decide that he or she wants to walk with a walker; similarly a user who uses a walker may not be able to spontaneously decide to switch to a wheelchair. A single device that can be converted between a wheelchair and a walker would provide significant convenience to this group of users.

A few devices that convert between wheelchair and walker are known in the art. An illustrative example is described in U.S. Pat. No. 6,338,493, "Walker Chair." The device described in this patent requires several steps for conversion between wheelchair and walker configurations; for example, each front wheel must be folded up out of the way, and the seat bottom must be folded up. Other devices known in the art also require multiple manual steps to convert between wheelchair and walker configurations. There are no known devices that provide a very simple one-step procedure to convert between wheelchair and walker configurations.

For at least the limitations described above there is a need for a wheelchair convertible to a walker.

BRIEF SUMMARY OF THE INVENTION

One or more embodiments described in the specification are related to a wheelchair convertible to a walker. Conversion between wheelchair and walker configurations may be performed by pushing handles forwards (to put the device into the walker configuration) or backwards (to put the device into the wheelchair configuration). When handles are pushed forward, the seat bottom of the wheelchair may fold up, providing an open area where the user can stand to use the device as a walker; the front wheels of the device may also be pushed forward.

One or more embodiments of the invention may include a frame with a left side and a right side. A seat back may be coupled at or near the back edge of the left and right side frames. A left back wheel may be coupled rotatably to the left side frame, and a right back wheel may be coupled rotatably to the right side frame. A left handle may be coupled to the left side frame at a left handle pivot, so that the left handle can rotate backwards around this pivot to a retracted position and forwards around this pivot to an extended position; similarly a right handle may be coupled to the right side frame at a right handle pivot. A seat bottom may be coupled to the left and right side frames, and it may rotate into either a folded down or folded up position. Linkages may connect the handles to the seat bottom. The device may also have left and right front wheels, which have back and forward positions. Linkages may connect the left handle to the left front wheel and the right handle to the right front wheel. When the left and right handles are in their retracted positions, the seat linkages may place the seat bottom in the folded down position, and the wheel linkages may place the front wheels in their back positions. When the left and right handles are in their extended positions, the seat linkages may place the seat bottom in the folded up position, and the wheel linkages may place the front wheels in their forward positions. When the seat bottom is folded up, an open area between the left and right frames may be provided so that the user can stand in this area; the user may use the left and right handles for support.

In one or more embodiments, the seat bottom may rotate around pivots on the left and right frames. The seat bottom may have a rear seat panel that extends behind the pivots when the seat bottom is folded down. The seat linkages may have left and right links that are coupled to the rear seat panel, and to the left and right handles, respectively. When the handles are in their extended positions, these left and right links may pull the rear seat panel downwards, causing the seat bottom to rotate to the folded up position.

In one or more embodiments, the left and right front wheel linkages may have a front wheel fork coupled to the front wheel, a horizontal link coupled to the fork, and a connecting link between the horizontal link and the left or right handle. The horizontal link may be constrained to slide along a horizontal slot in the corresponding left or right side frame.

In one or more embodiments, the front wheel forward positions may be at least 200 millimeters forward of the front wheel back positions.

BRIEF DESCRIPTION OF THE DRAWINGS

The above and other aspects, features and advantages of the invention will be more apparent from the following more particular description thereof, presented in conjunction with the following drawings wherein:

FIG. 6A shows the handles retracted (wheelchair) position and FIG. 6B shows the handles extended (walker) position.

FIG. 7A shows the handles retracted (wheelchair) position and FIG. 7B shows the handles extended (walker) position.

DETAILED DESCRIPTION OF THE INVENTION

A wheelchair convertible to a walker will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1B:
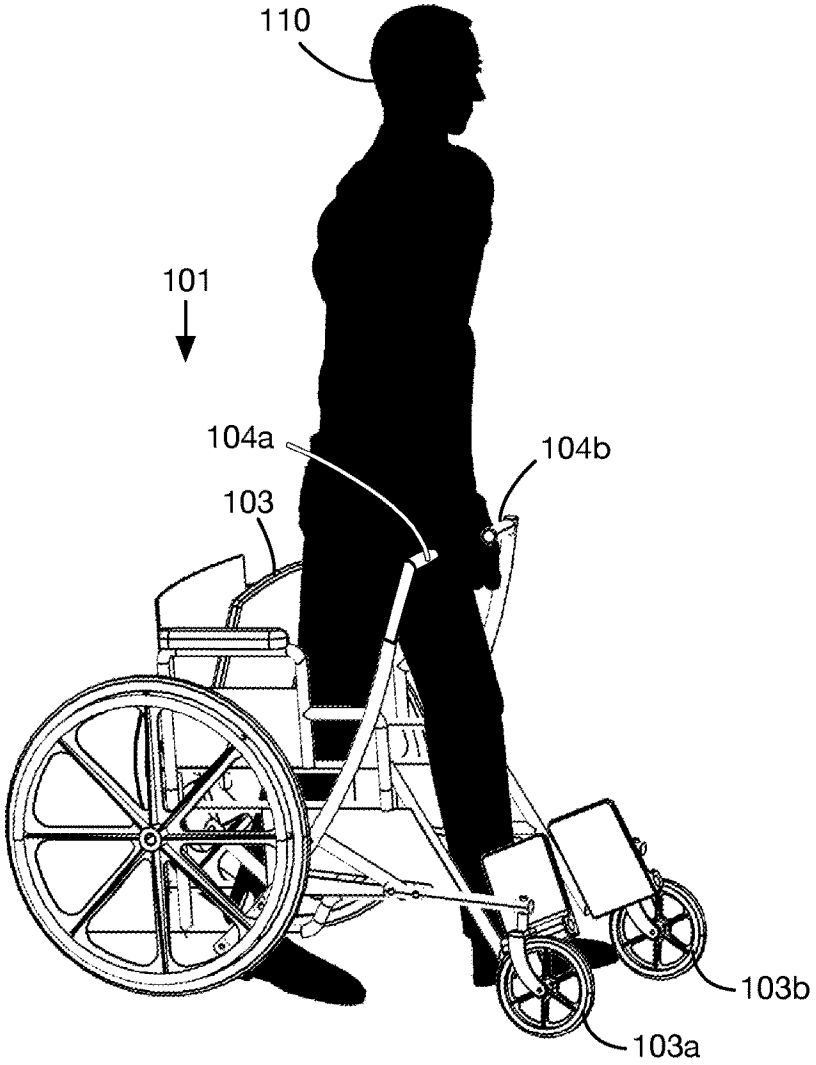
FIG. 1B shows this embodiment converted to a walker configuration.
Figure 1A:
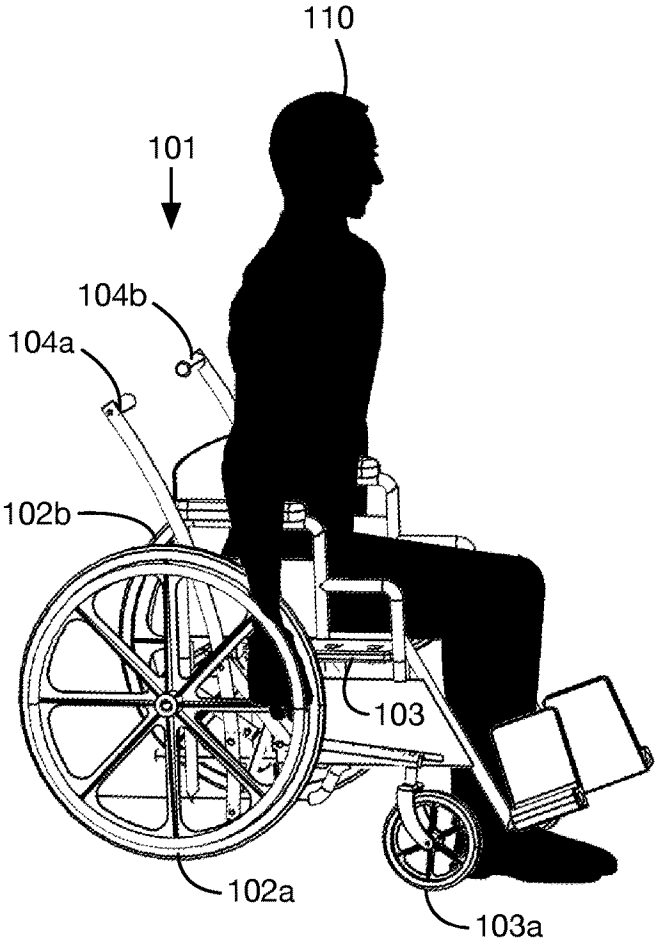
FIG. 1A shows an embodiment of the invention in a wheelchair configuration.

FIGS. 1A and 1B show an embodiment of the invention 101, with a user 110 using the embodiment. This embodiment 101 is a personal transportation aid that may be put into either a wheelchair configuration, as shown in FIG. 1A, or a walker configuration, as shown in FIG. 1B. User 110, or an assistant, can convert the device easily and immediately from the wheelchair configuration to the walker configuration by pushing forward on handles 104*a* and 104*b*. These handles are retracted (for example, behind the user) in the wheelchair configuration shown in FIG. 1A. When handles 104*a* and 104*b* are pushed forward, as shown in FIG. 1B, the seat bottom 103 of the wheelchair folds up, and the front wheels 103*a* and 103*b* of the device move forward, providing an unobstructed area within which user 110 can stand. The user may then use the device as a walker, and may use the handles 104*a* and 104*b* for support. The user may return the device to the wheelchair configuration simply by pulling back on handles 104*a* and 104*b*. A benefit of this invention is that the conversion between wheelchair and walker configurations is extremely simple and rapid. This conversion requires no motors or other actuators, so the device requires no power source. The conversion mechanism may use simple linkages in one or more embodiments, as described below, so the device may be inexpensive and robust.

Figure 2B:
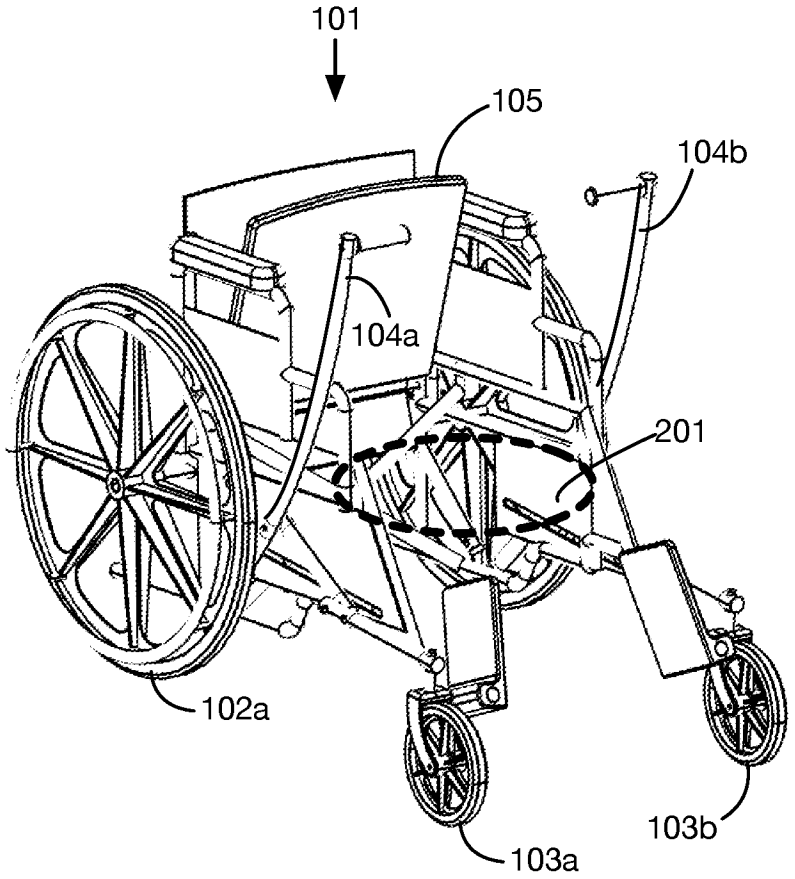
FIGS. 2A and 2B show the device of FIGS. 1A and 1B, respectively, without the user, to better illustrate the device components.
Figure 2A:
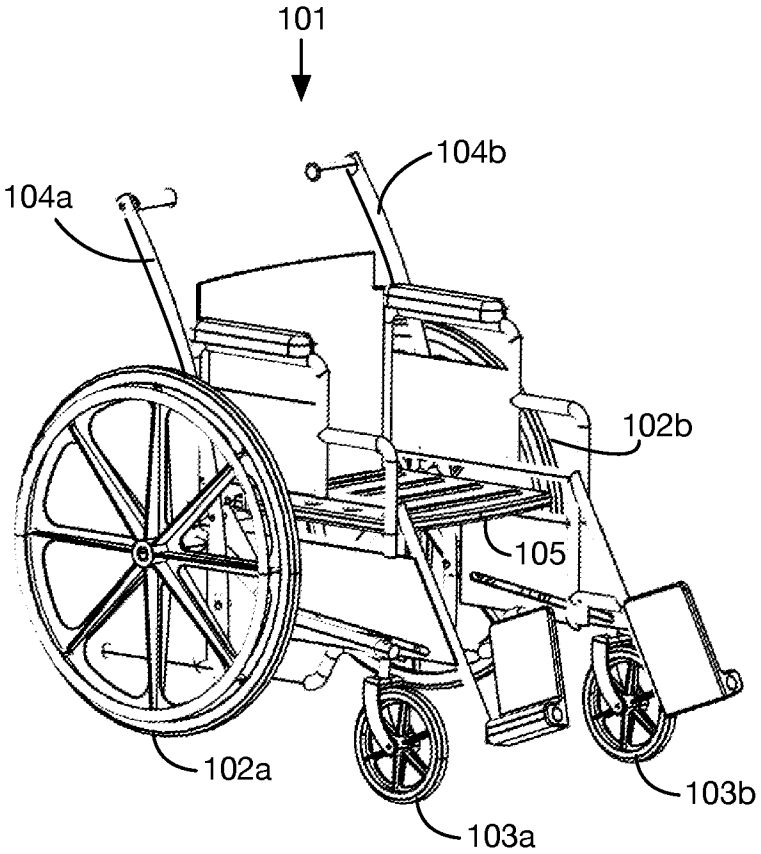

FIGS. 2A and 2B show the device of FIGS. 1A and 1B, respectively, without the user. The device has a chassis onto which back wheels 102*a* and 102*b* are attached. These wheels may be for example typical wheelchair wheels that can be gripped and turned by the user. In FIG. 2A, the device is in the wheelchair configuration and seat bottom 105 is folded down so that the user can sit on the seat bottom. In FIG. 2B, handles 104*a* and 104*b* are pushed forwards, causing seat 105 to flip up (towards the seat back). Front wheels 103*a* and 103*b* are pushed forwards. These changes leave an open area 201 where the user can stand to use the device as a walker. Any type of known brake may optionally engage with or otherwise prevent back wheels 102*a* and/or 102*b* and/or front wheels 103*a* and/or 103*b* from rotating.

Figure 3:
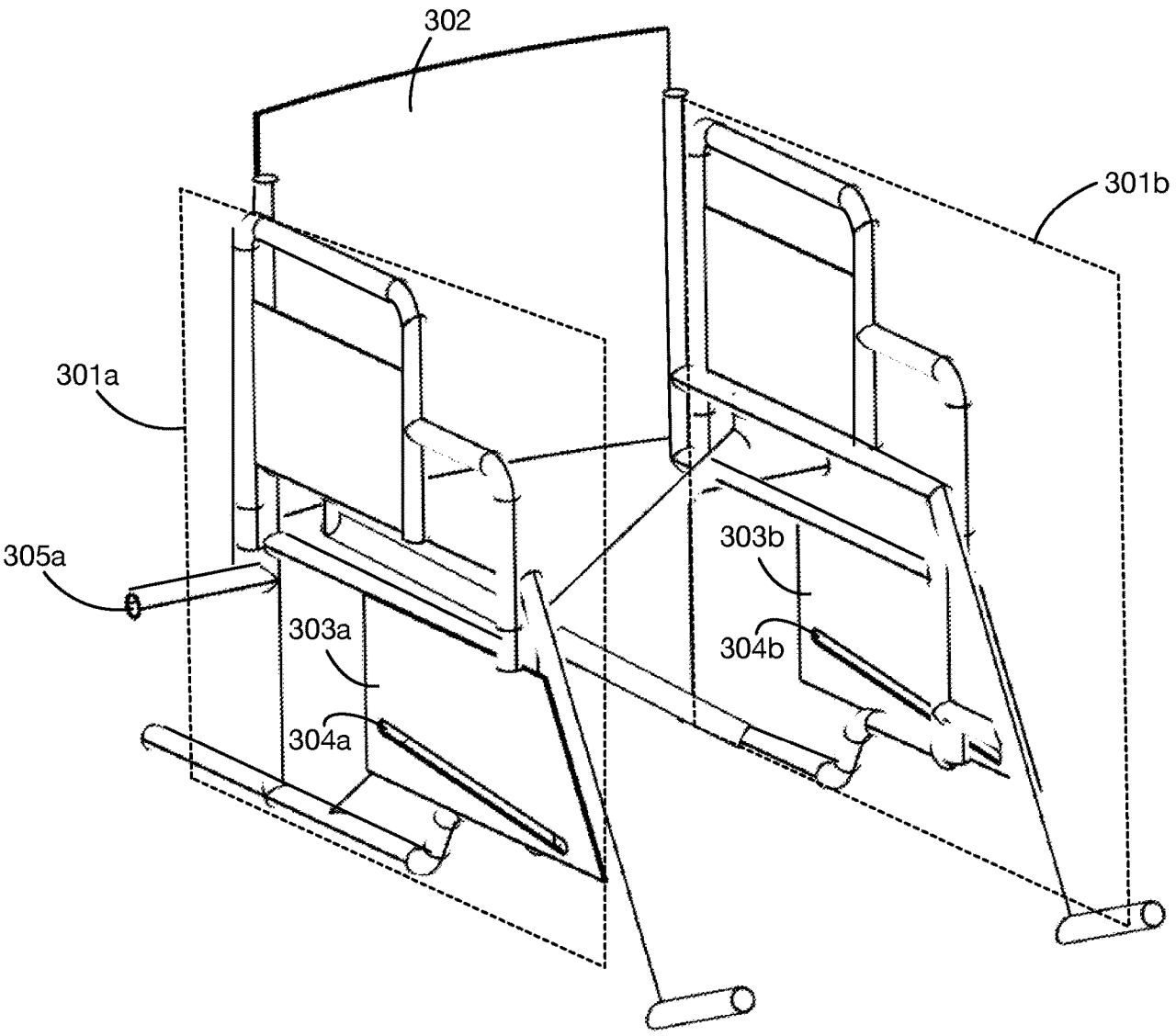
FIG. 3 shows the side frames and back of the embodiment of FIG. 1A, with the wheels, seat bottom, and handles removed.

FIG. 3 shows an illustrative frame and seat back for an embodiment of the invention. This view of the device does not include the wheels, seat bottom, handles, or linkages that move the seat bottom and front wheels. A right side frame 301*a* and a corresponding left side frame 301*b* may each contain one or more bars, tubes, plates, sheets, connectors, rods, or other members. The configuration shown is illustrative; in one or more embodiments the left and right frames may have any desired shapes, dimensions, or components. A seat back 302 may be connected to the left frame 301*b* and the right frame 301*a*, for example at or near the back edges of these frames. In one or more embodiments, other cross-members may connect the left frame and the right frame; however the space between the left and right frames may include an open area where the user can stand when the seat bottom is folded up (as in FIG. 2B, for example).

In one or more embodiments, the left frame 301*b* and right frame 301*a* may have panels or similar components 303*b* and 303*a*, respectively, with horizontal slots 304*b* and 304*a*, respectively. These slots may constrain the linkages that move the front wheels forward, as described below.

In one or more embodiments the left and right frames may also have pivots or other connection points for the back wheels and for the handles, or for any other components of the device. For example, right back wheel 102*a* may be coupled to rotate around a member 305*a* that is connected to or integrated into the right side frame 301*a*, and a similar connection may be made between the left back wheel 102*b* and the left side frame 301*b*.

Figure 4:
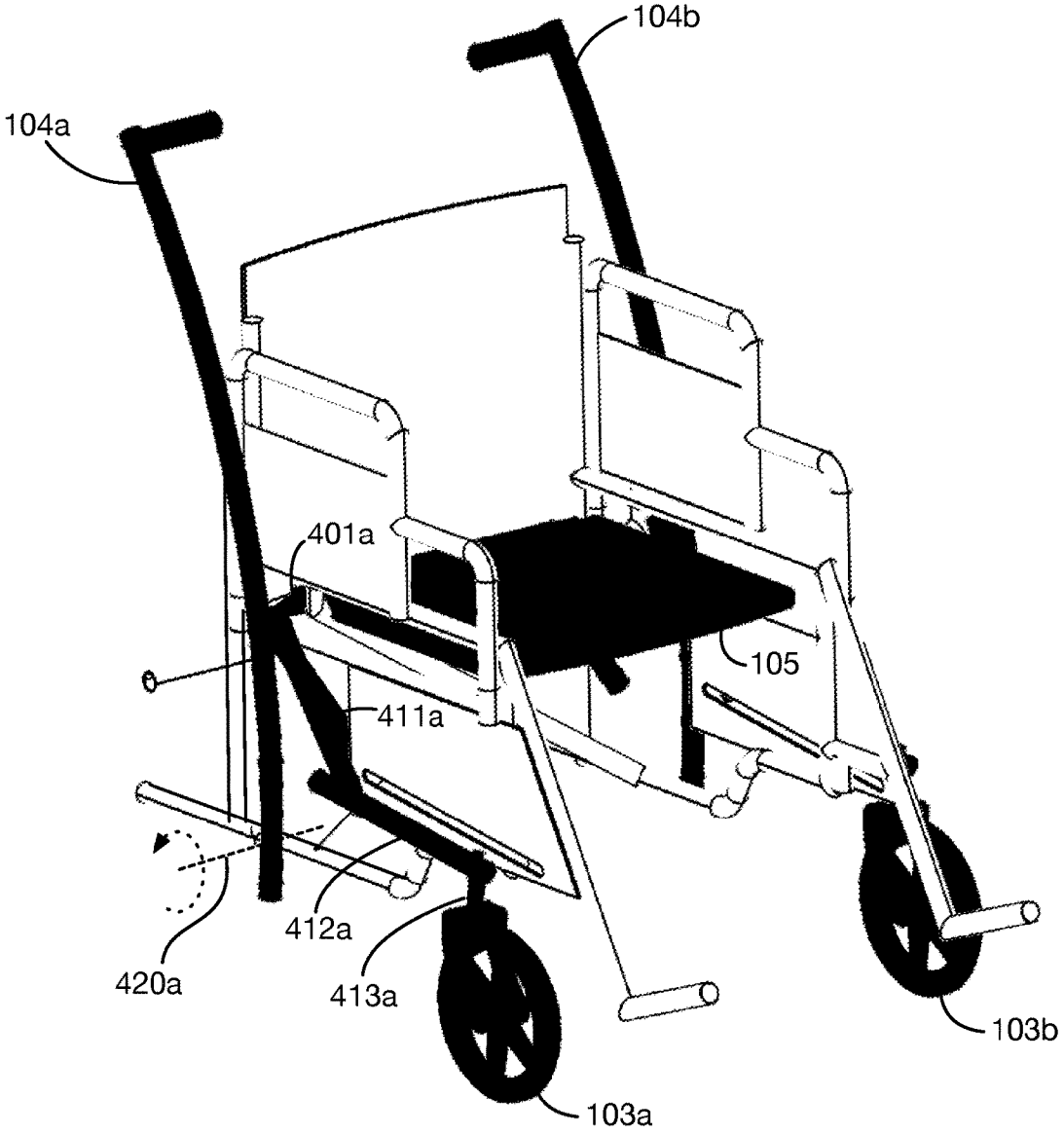
FIG. 4 shows the frame of FIG. 3 with handles and linkages added to control movement of the seat bottom and of the front wheels.
Figure 5:
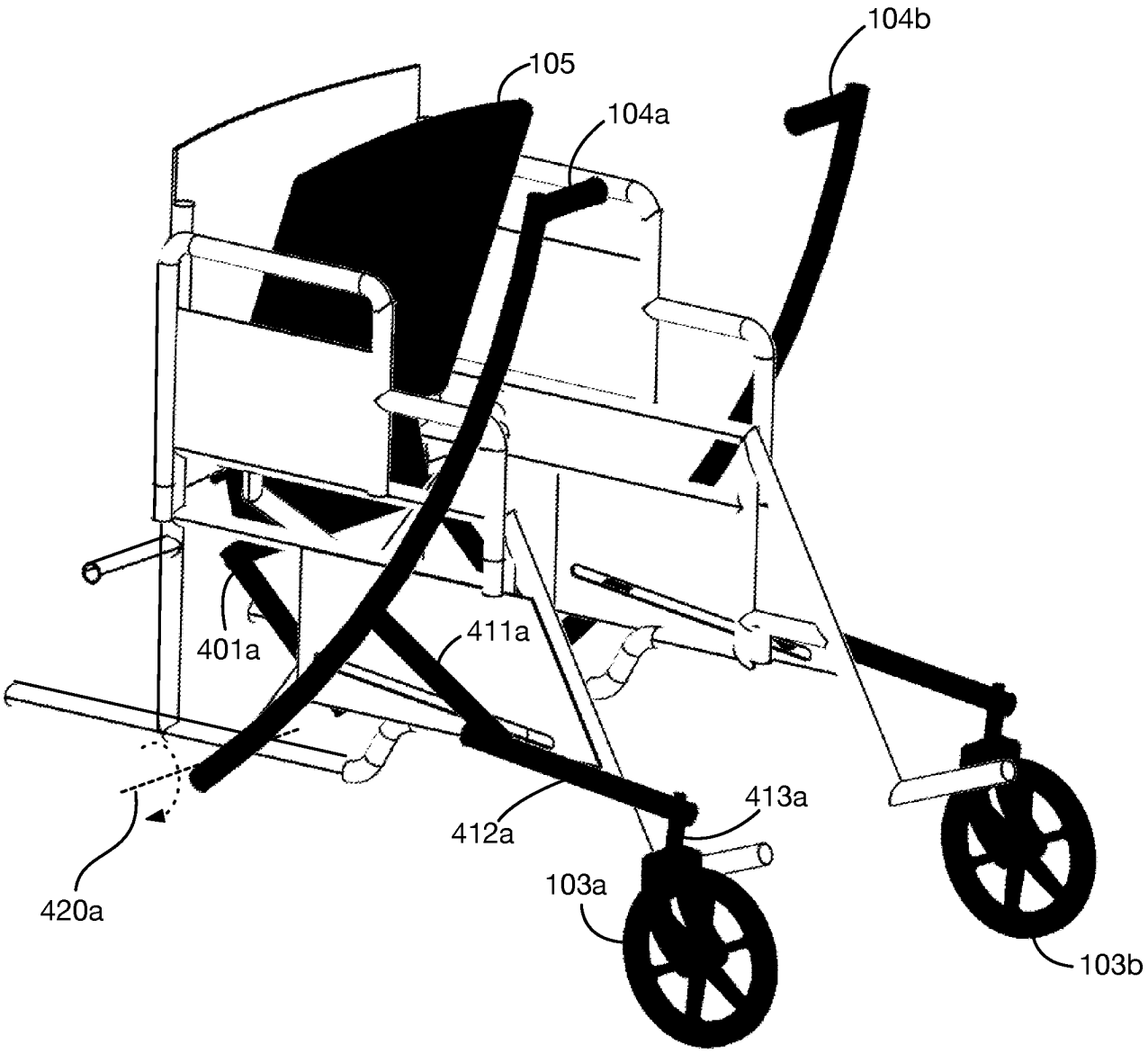
FIG. 5 shows the device of FIG. 4 with the handles pushed forward to put the device into the walker configuration, with the seat bottom folded up and the front wheels pushed forward.

FIGS. 4 and 5 show illustrative linkages that may be used in one or more embodiments to move the seat bottom and the front wheels when the user moves the left handle 104*b* and right handle 104*a* forwards and backwards. FIG. 4 shows the embodiment with the handles back, in the wheelchair position, and FIG. 5 shows the embodiment with the handles forward, in the walker position. The handles 104*a* and 104*b*, and the linkages attached to these handles, are shown in black for emphasis. Right handle 104*a* may for example be coupled to the right side frame at a pivot 420*a*, so that the handle can rotate forward (for walker mode, shown in FIG. 5) and backward (for wheelchair mode, shown in FIG. 4) around this pivot; a similar privot may exist between left handle 104*b* and the left side frame. A wheel linkage may connect the right side handle 104*a* to the front right wheel 103*a*, and a similar linkage may connect the left side handle 104*b* to the left front wheel 103*b*. Linkages may also connect the handles to the seat bottom 105. In one or more embodiments, linkages between handles and wheels, and between handles and the seat bottom, may consist of any number of members linked in any type of configuration. Any linkages that result in flipping the seat bottom upwards and that move the front wheels forwards when the handles are moved forwards may be used in one or more embodiments of the invention. In the embodiment shown in FIGS. 4 and 5, and described in detail in subsequent figures, the right wheel linkage includes a fork 413*a* that holds the right front wheel 103*a*, a horizontal link 412*a* attached to this fork, and another link 411*a* that connects link 412*a* to the right handle 104*a*. The left wheel linkage is similar. The right seat linkage includes a link 401*a* that connects right handle 104*a* to seat bottom 105, and a similar linkage connects the left handle 104*b* to the seat bottom 105.

Figure 6B:
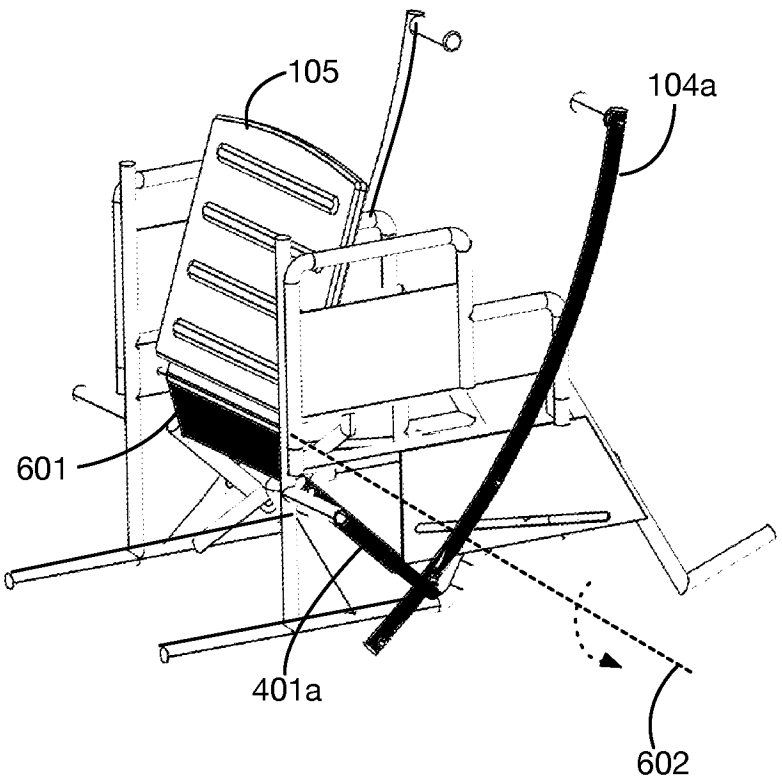
FIGS. 6A and 6B show details of the linkage between the handles and the seat bottom.
Figure 6A:
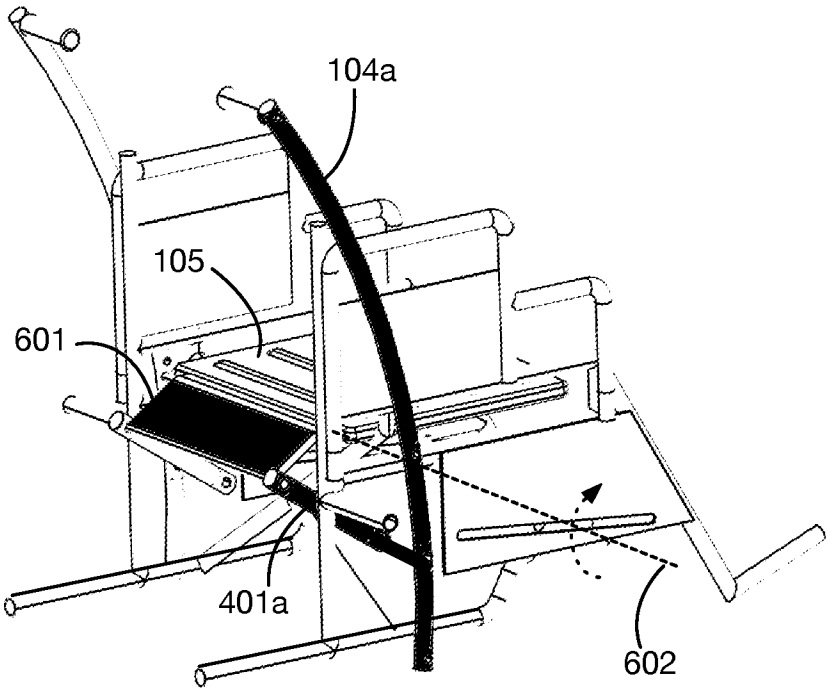

FIGS. 6A and 6B show details of the seat linkages of the embodiment of FIGS. 4 and 5; FIG. 6A shows the handles retracted position (wheelchair mode) and FIG. 6B shows the handles forward position (walker mode). In this illustrative embodiment, seat bottom 105 rotates around pivots in the left and right frames, around axis 602. The seat bottom 105 has (or is coupled to) a rear seat panel 601 that is behind these pivots when the seat bottom is in the folded down position (as shown in FIG. 6A). Link 401*a* of the right seat linkage is connected to this rear seat panel, and to the right handle 104*a*. When the handle 104*a* (and the left handle as well) is pushed forward to the position shown in FIG. 6B, the rear seat panel 601 is pulled downwards and forward, causing the seat bottom 105 to flip up for the walker configuration.

Figure 7B:
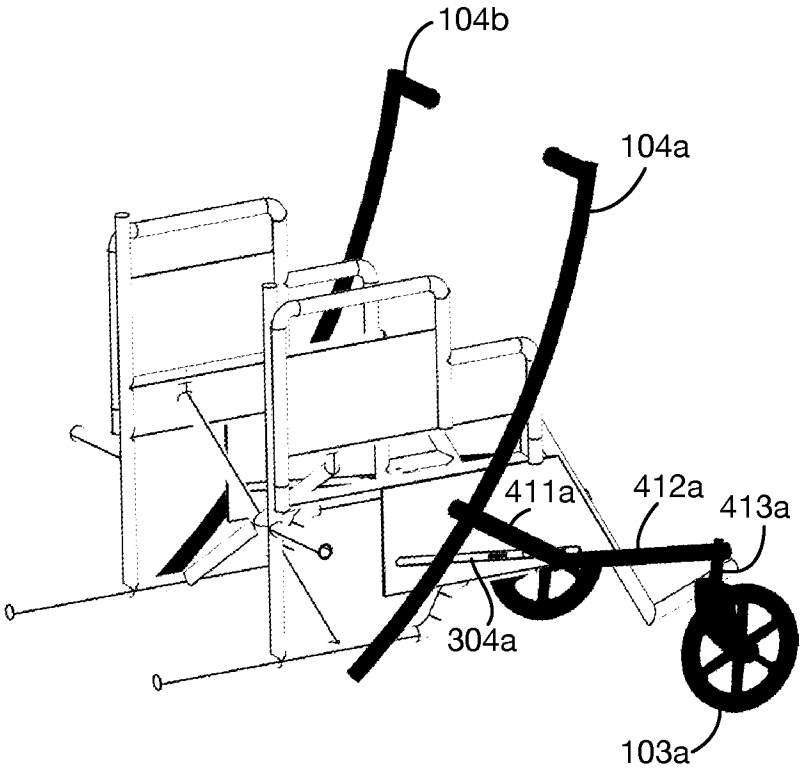
FIGS. 7A and 7B show details of the linkage between the handles and the front wheels.
Figure 7A:
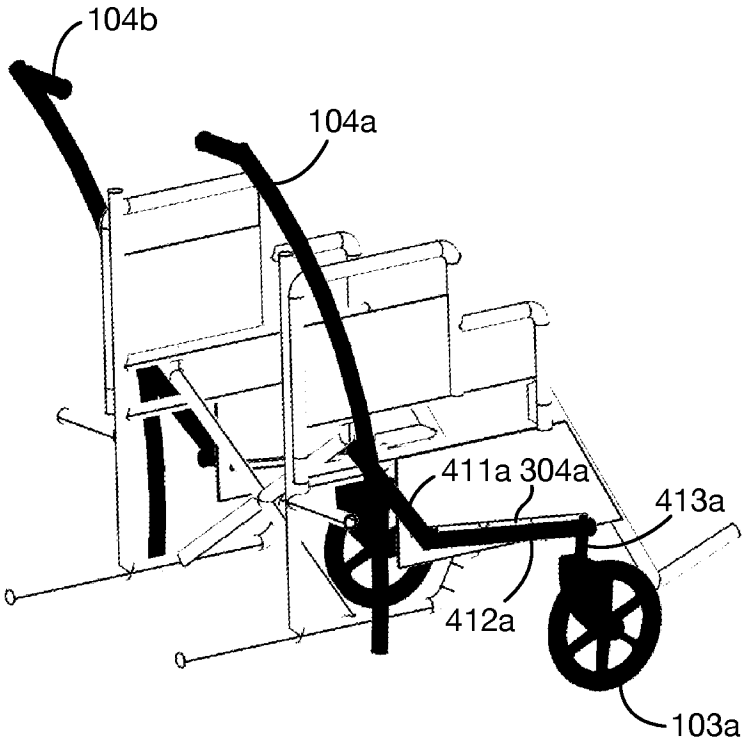

FIGS. 7A and 7B show details of the front wheel linkages of the embodiment of FIGS. 4 and 5; FIG. 7A shows the handles retracted position (wheelchair mode) and FIG. 7B shows the handles forward position (walker mode). In this illustrative embodiment, horizontal link 412*a* includes or is attached to components that slide inside horizontal slot 304*a* in the right side frame, and the corresponding link on the left side slides inside a corresponding horizontal slot in the left side frame. As the handles are pushed forward, link 411*a* pushes link 412*a* forward in this slot, which moves right front wheel 103*a* forward. The distance that the front wheels move forward may vary in different embodiments; in one or more embodiments, for example, the front wheels may move approximately 200 millimeters forward or more when the handles are moved from the retracted to the extended positions.

While the invention herein disclosed has been described by means of specific embodiments and applications thereof, numerous modifications and variations could be made thereto by those skilled in the art without departing from the scope of the invention set forth in the claims.

What is claimed is:

1. A wheelchair convertible to a walker, comprising:

a left side frame;

a right side frame;

a seat back coupled to a back edge of said left side frame and to a back edge of said right side frame;

a left back wheel coupled rotatably to said left side frame;

a right back wheel coupled rotatably to said right side frame;

a left handle coupled rotatably to said left side frame at a left handle pivot, and configured to rotate backwards around said left handle pivot to a left handle retracted position and to rotate forwards around said left handle pivot to a left handle extended position;

a right handle coupled rotatably to said right side frame at a right handle pivot, and configured to rotate backwards around said right handle pivot to a right handle retracted position and to rotate forwards around said right handle pivot to a right handle extended position;

a seat bottom coupled rotatably to said left side frame and to said right side frame, said seat bottom comprising a folded down position and a folded up position;

a left seat linkage coupled to said seat bottom and to said left handle;

a right seat linkage coupled to said seat bottom and to said right handle;

a left front wheel comprising a left front wheel back position and a left front wheel forward position;

a right front wheel comprising a right front wheel back position and a right front wheel forward position;

a left wheel linkage coupled to said left front wheel and to said left handle; and, a right wheel linkage coupled to said right front wheel and to said right handle;

wherein when said left handle is in said left handle retracted position and said right handle is in said right handle retracted position, said left seat linkage and said right seat linkage position said seat bottom in said folded down position onto which a user can sit;

when said left handle is in said left handle extended position and said right handle is in said right handle extended position, said left seat linkage and said right seat linkage position said seat bottom in said folded up position, providing an open area between said left side frame and said right side frame where said user can stand, and wherein said user can use said left handle and said right handle as supports;

when said left handle is in said left handle retracted position and said right handle is in said right handle retracted position, said left wheel linkage and said right wheel linkage position said left front wheel in said left front wheel back position and said right front wheel in said right front wheel back position; and, when said left handle is in said left handle extended position and said right handle is in said right handle extended position, said left wheel linkage and said right wheel linkage position said left front wheel in said left front wheel forward position and said right front wheel in said right front wheel forward position.

2. The wheelchair convertible to a walker of claim 1, wherein said seat bottom is configured to rotate around a left side seat pivot on said left side frame and around a right side seat pivot on said right side frame;

said seat bottom comprises a rear seat panel that extends behind said left side seat pivot and said right side seat pivot when said seat bottom is in said folded down position;

said left seat linkage comprises a left seat link coupled to said rear seat panel and to said left handle; and, said right seat linkage comprises a right seat link coupled to said rear seat panel and to said right handle;

wherein when said left handle is in said left handle extended position and said right handle is in said right handle extended position, said left seat link and said right seat link pull said rear seat panel downwards, causing said seat bottom to rotate to said folded up position.

3. The wheelchair convertible to a walker of claim 1, wherein said left wheel linkage comprises a left front wheel fork coupled to said left front wheel;

a left front wheel horizontal link coupled to said left front wheel fork, wherein said left front wheel horizontal link is constrained to slide along a left horizontal slot in said left side frame; and a left front wheel connecting link coupled to said left front wheel horizontal link and to said left handle; and, said right wheel linkage comprises a right front wheel fork coupled to said right front wheel;

a right front wheel horizontal link coupled to said right front wheel fork, wherein said right front wheel horizontal link is constrained to slide along a right horizontal slot in said right side frame; and a right front wheel connecting link coupled to said right front wheel horizontal link and to said right handle.

4. The wheelchair convertible to a walker of claim 1, wherein said left front wheel forward position is at least 200 millimeters forward of said left front wheel back position; and, said right front wheel forward position is at least 200 millimeters forward of said right front wheel back position.

5. A wheelchair convertible to a walker, comprising:

a left side frame;

a right side frame;

a seat back coupled to a back edge of said left side frame and to a back edge of said right side frame;

a left back wheel coupled rotatably to said left side frame;

a right back wheel coupled rotatably to said right side frame;

a left handle coupled rotatably to said left side frame at a left handle pivot, and configured to rotate backwards around said left handle pivot to a left handle retracted position and to rotate forwards around said left handle pivot to a left handle extended position;

a right handle coupled rotatably to said right side frame at a right handle pivot, and configured to rotate backwards around said right handle pivot to a right handle retracted position and to rotate forwards around said right handle pivot to a right handle extended position;

a seat bottom coupled rotatably to said left side frame at a left side seat pivot and to said right side frame at a right side seat pivot, said seat bottom comprising a folded down position and a folded up position, wherein said seat bottom comprises a rear seat panel that extends behind said left side seat pivot and said right side seat pivot when said seat bottom is in said folded down position;

a left seat linkage coupled to said seat bottom and to said left handle, said left seat linkage comprising a left seat link coupled to said rear seat panel and to said left handle;

a right seat linkage coupled to said seat bottom and to said right handle, said right seat linkage comprising a right seat link coupled to said rear seat panel and to said right handle;

a left front wheel comprising a left front wheel back position and a left front wheel forward position;

a right front wheel comprising a right front wheel back position and a right front wheel forward position;

a left wheel linkage coupled to said left front wheel and to said left handle, comprising a left front wheel fork coupled to said left front wheel;

a left front wheel horizontal link coupled to said left front wheel fork, wherein said left front wheel horizontal link is constrained to slide along a left horizontal slot in said left side frame; and a left front wheel connecting link coupled to said left front wheel horizontal link and to said left handle; and, a right wheel linkage coupled to said right front wheel and to said right handle, comprising a right front wheel fork coupled to said right front wheel;

a right front wheel horizontal link coupled to said right front wheel fork, wherein said right front wheel horizontal link is constrained to slide along a right horizontal slot in said right side frame; and a right front wheel connecting link coupled to said right front wheel horizontal link and to said right handle;

wherein said left front wheel forward position is at least 200 millimeters forward of said left front wheel back position;

said right front wheel forward position is at least 200 millimeters forward of said right front wheel back position;

when said left handle is in said left handle retracted position and said right handle is in said right handle retracted position, said left seat linkage and said right seat linkage position said seat bottom in said folded down position onto which a user can sit;

when said left handle is in said left handle extended position and said right handle is in said right handle extended position, said left seat link and said right seat link pull said rear seat panel downwards, causing said seat bottom to rotate to said folded up position, providing an open area between said left side frame and said right side frame where said user can stand, and wherein said user can use said left handle and said right handle as supports;

when said left handle is in said left handle retracted position and said right handle is in said right handle retracted position, said left wheel linkage and said right wheel linkage position said left front wheel in said left front wheel back position and said right front wheel in said right front wheel back position; and, when said left handle is in said left handle extended position and said right handle is in said right handle extended position, said left wheel linkage and said right wheel linkage position said left front wheel in said left front wheel forward position and said right front wheel in said right front wheel forward position.

* * * * *